US005741156A

United States Patent [19]

Wilson

[11] Patent Number: 5,741,156

[45] Date of Patent: Apr. 21, 1998

[54] PROTECTIVE COVER FOR ELECTRICAL CONNECTOR

[75] Inventor: Richard Dwayne Wilson, Greensboro, N.C.

[73] Assignee: The Whitaker Corporation, Wilmington, Del.

[21] Appl. No.: 747,118

[22] Filed: Nov. 8, 1996

[51] Int. Cl.[6] ..... H01R 13/52

[52] U.S. Cl. ..... 439/521; 439/523; 439/587

[58] Field of Search ..... 439/523, 521, 439/274, 275, 587

[56] References Cited

U.S. PATENT DOCUMENTS

| | | | |
|---|---|---|---|
| 3,869,189 | 3/1975 | McCurdy | 439/523 |
| 4,109,989 | 8/1978 | Snyder, Jr. et al. | 339/94 M |
| 4,538,869 | 9/1985 | Richards | 339/59 M |
| 4,698,459 | 10/1987 | Drake | 174/138 |
| 4,789,348 | 12/1988 | Hampton | 439/142 |
| 4,795,857 | 1/1989 | McInnis | 439/521 |
| 4,917,617 | 4/1990 | Smith | 439/135 |
| 4,986,772 | 1/1991 | Fukutani | 439/892 |
| 5,122,081 | 6/1992 | Bogiel et al. | 439/596 |
| 5,190,475 | 3/1993 | Dickens | 439/289 |
| 5,256,072 | 10/1993 | Hatagishi | 439/79 |
| 5,347,084 | 9/1994 | Roney et al. | 439/521 |
| 5,454,732 | 10/1995 | Denovich et al. | 439/523 |
| 5,538,441 | 7/1996 | Paolucci et al. | 439/589 |
| 5,586,905 | 12/1996 | Marshall et al. | 439/463 |

FOREIGN PATENT DOCUMENTS 07312269 11/1995 Japan .

*Primary Examiner*—Gary F. Paumen
*Attorney, Agent, or Firm*—Robert Kapalka

[57] ABSTRACT

A protective cover for an electrical connector comprises a shell having a wall and an aperture extending through the wall to permit a wire leading from the connector to pass out of the shell. The aperture is surrounded by a flexible skirt which is dimensioned to seal around the wire. The skirt keeps contaminants from entering the cover and provides a strain relief for the wire.

16 Claims, 2 Drawing Sheets

PROTECTIVE COVER FOR ELECTRICAL CONNECTOR

FIELD OF THE INVENTION

The invention relates to a protective cover for keeping contaminants out of an electrical connector.

BACKGROUND OF THE INVENTION

Electrical connectors are often used in environments where they are exposed to dust and dirt, and may even be used in environments where they are subject to splash from water. When these contaminants enter an electrical connector housing, contacts in the housing may become coated with contaminants or corroded by oxidation, thereby leading to intermittent and unreliable electrical connections. Protective covers are known for keeping contaminants out of an electrical connector housing.

U.S. Pat. No. 4,789,348 discloses an electrical connector having a dust cover formed as a unitary body having hinged flaps configured to wrap around the connector. The cover has holes which permit wires attached to the connector to pass through the cover. Ideally, the holes are sized to closely surround the wires which pass therethrough, but the holes must be slightly larger than the wires to ensure that the wires will be insertable through the holes. Further, dimensional tolerances on the wires and the holes can result in significant gaps around the wires, and these gaps provide leakage paths through which contaminants can enter the protective cover. There is a need for a cover with an improved seal around wires which pass through the cover.

SUMMARY OF THE INVENTION

It is an object of the invention to provide a protective cover for an electrical connector.

It is another object of the invention to improve the seal around wires which pass through a protective cover of an electrical connector.

The invention is a protective cover comprising a shell having a wall and an aperture extending through the wall, the aperture being surrounded by a flexible skirt having an inner edge which defines a cross-sectional dimension of the aperture, the cross-sectional dimension being less than a cross-sectional dimension of a wire which is to be installed through the aperture, wherein the skirt is sealingly engageable with the wire.

BRIEF DESCRIPTION OF THE DRAWINGS

The invention will now be described by way of example with reference to the accompanying drawings wherein.

DETAILED DESCRIPTION OF THE PREFERRED EMBODIMENT

Figure 1:
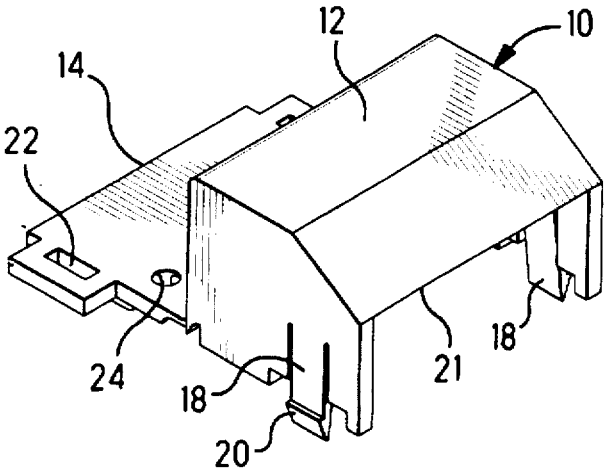
FIG. 1 is an isometric view of a protective cover according to the invention.
Figure 2:
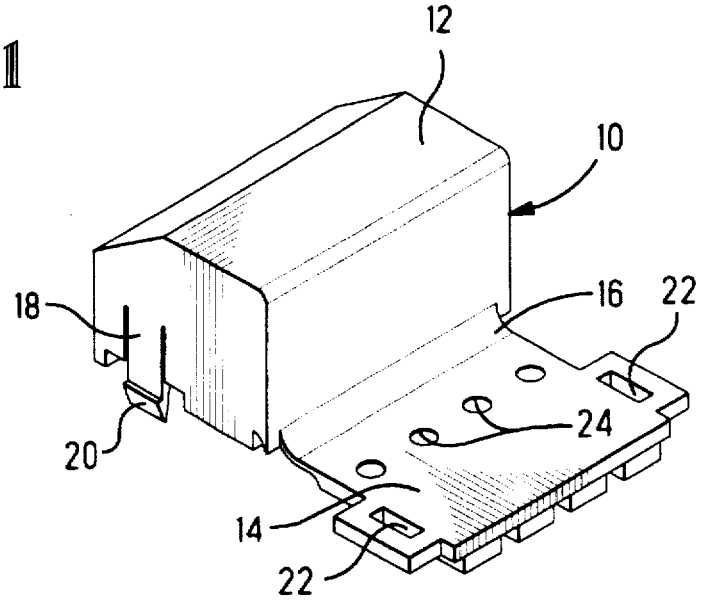
FIG. 2 is an isometric view of the cover in a different orientation.
Figure 3:
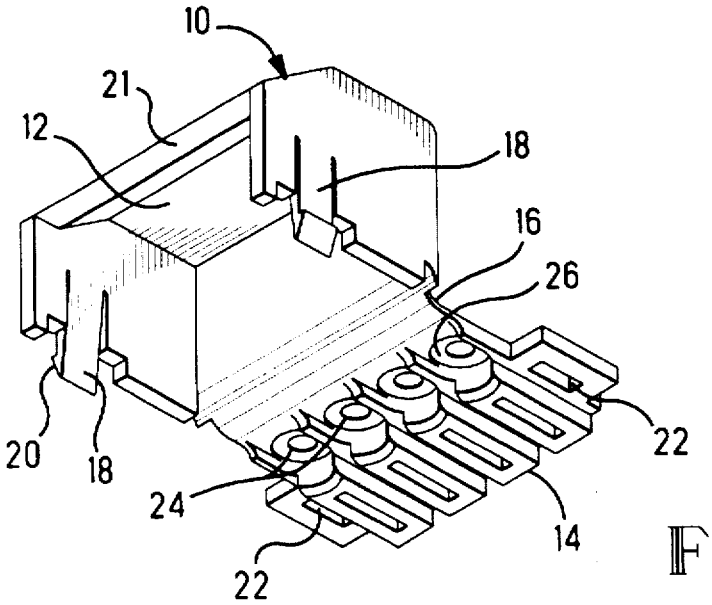
FIG. 3 is an isometric view of the cover in yet another orientation.

There is shown in FIGS. 1–3 an electrical connector protective cover comprising a shell 10 which is preferably a unitary body molded from plastic material. The shell 10 includes a receptacle portion 12 and a flap or wall 14 which is connected to the receptacle portion 12 by a flexible hinge 16. The receptacle portion 12 is dimensioned to receive an electrical connector therein and to closely surround and support the connector. The hinge 16 enables the wall 14 to be moved from an open position which permits insertion of the connector into the receptacle portion, to a closed position which retains the connector in the shell. The shell 10 has a latch mechanism for securing the wall 14 in the closed position. The latch mechanism includes a pair of resilient latch arms 18 which are connected to the receptacle portion 12. Each of the latch arms 18 has a latch projection 20 which is insertable through a respective cutout 22 in the wall 14 and is engageable behind the wall to hold the wall in the closed position. An end wall of the shell has an opening 21 which permits a mating connector to be plugged into the connector within the shell when the wall 14 is closed.

The shell 10 has at least one aperture 24 which permits a wire leading from the connector which is enclosed by the shell to pass out of the shell. The number of apertures 24 may be varied to correspond with the number of wires leading from the connector. In the illustrated embodiment, four of the apertures 24 are aligned side-by-side in a linear array along the wall 14. The wires for a connector are inserted through respective ones of the apertures 24 when the wall is in the open position. The wires are then terminated to respective contacts in the connector either before or after the connector is installed in the receptacle portion 12 of the shells, whereupon the wall 14 may be closed and latched to secure the shell around the connector.

Figure 4:
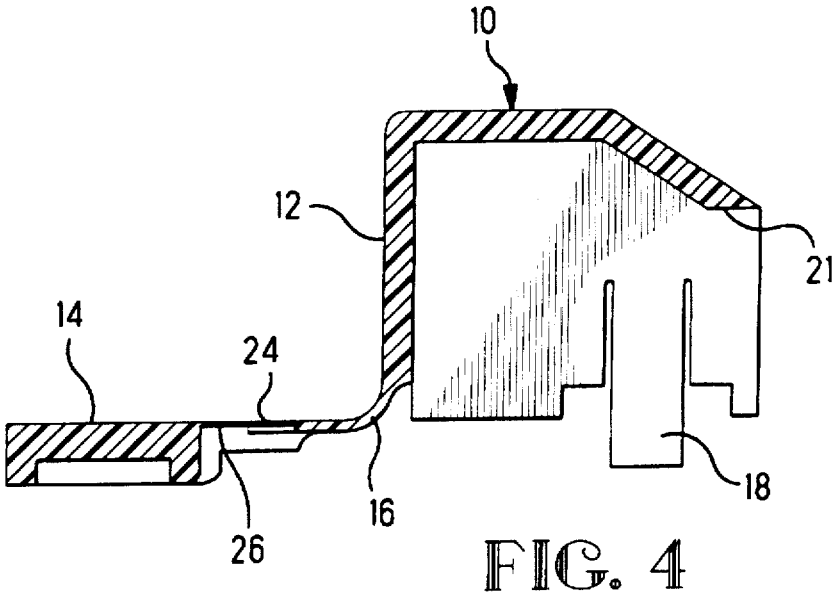
FIG. 4 is a cross-sectional view through the cover.
Figure 5:
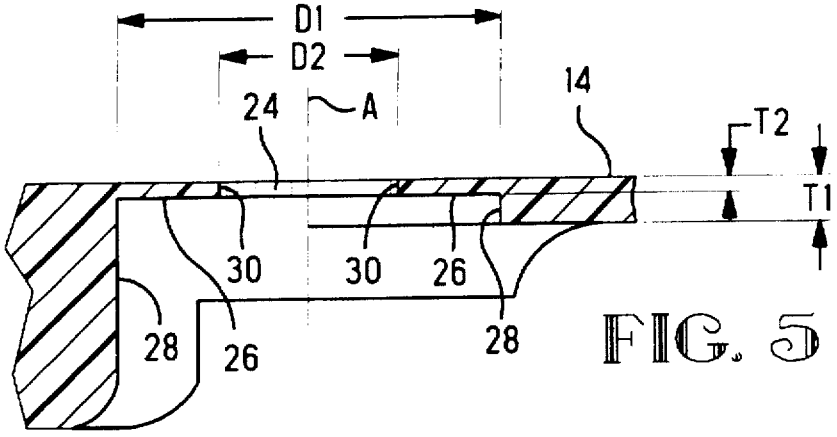
FIG. 5 is an enlarged cross-sectional view through a portion of the cover shown in FIG. 4.

With reference to FIGS. 4 and 5, each of the apertures 24 is surrounded by a flexible skirt 26 which is dimensioned for sealing engagement around a wire which is to be installed in the aperture. In a preferred embodiment, the skirt 26 is integrally molded with the wall 14 and is formed as a reduced thickness portion of the wall.

As shown in the enlarged cross-sectional view of FIG. 5, the wall 14 has a thickness T1 which is on the order of 0.040 inch (1.02 mm). The wall around each of the apertures 24 has a counterbore which defines a bore surface 28 that is coaxial with a central axis A of the aperture 24. The counterbore is dimensioned to be larger than the diameter of the largest wire that is to be inserted through the aperture 24. In the present example the counterbore has a diameter D1 on the order of 0.130 inch (3.30 mm). The skirt 26 extends inwardly from the bore surface 28 toward the axis A of the aperture 24 and is formed with a reduced thickness T2 which is on the order of 0.005 inch (0.13 mm). The aperture 24 is defined by an inner edge 30 of the skirt 26 which in the present example is circular and has a diameter D2 on the order of 0.060 inch (1.52 mm). The skirt in the present example is specially suited for sealing engagement with wires having a diameter between 0.060 inch (1.52 mm) and 0.100 inch (2.54 mm). By appropriate selection of dimensions, the skirt can be made suitable for sealing engagement with a range of wire sizes. A wire having a diameter which is smaller than the aperture diameter D2 can be accommodated in the aperture, but the benefit of the seal provided by the skirt will not be obtained.

Figure 6:
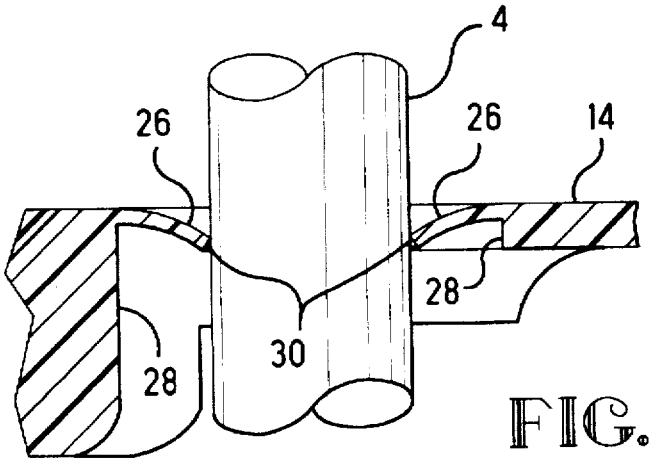
FIG. 6 is a cross-sectional view showing a wire installed through an aperture in the cover.

FIG. 6 illustrates a wire 4 which is installed in the aperture that is defined by the inner edge 30 of the skirt 26. The skirt has been flexed axially inwardly by the wire and the inner edge of the skirt provides a circumferential seal around the wire. A leading end of the wire 4 can then be terminated in the connector which is to be received in the shell. The deformed skirt resists pullout of the wire and thereby provides a measure of strain relief for the wire.

The invention has been described with reference to an aperture and a skirt having a circular configuration which can accommodate an ordinary circular wire. However, it should be understood that the invention could be utilized in a cover that accommodates wires having other cross-sectional shapes by appropriate modification of the size and shape of the aperture and the skirt.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

I claim:

1. A protective cover for an electrical connector, comprising:

a shell having a wall and an aperture extending through the wall, the aperture being surrounded by a flexible skirt unitary with the wall and having an inner edge which defines a cross-sectional dimension of the aperture, the cross-sectional dimension being less than a cross-sectional dimension of a wire which is to be installed through the aperture, wherein the skirt is sealingly engageable with the wire.

2. The protective cover according to claim 1, wherein a thickness of the skirt is less than a thickness of the wall.

3. The protective cover according to claim 2, wherein the aperture is surrounded by a counterbore which defines a bore surface in the wall, and the skirt extends inwardly from the bore surface.

4. The protective cover according to claim 1, wherein the skirt is integrally molded with the wall.

5. The protective cover according to claim 1, wherein the shell includes a receptacle portion which is dimensioned to receive the connector therein, and the wall is hingedly connected to the receptacle portion.

6. The protective cover according to claim 5, wherein the shell includes a latch mechanism for securing the wall in a closed position on the receptacle portion.

7. The protective cover according to claim 1, wherein the shell includes a plurality of said apertures arrayed linearly along the wall.

8. The protective cover according to claim 1, wherein the inner edge of the skirt is circular.

9. A protective cover for an electrical connector, comprising:

a shell having a wall, an aperture extending through the wall, and a flexible skirt surrounding the aperture, the skirt unitary with the wall and being dimensioned for sealing engagement with a wire when the wire is installed through the aperture.

10. The protective cover according to claim 9, wherein a thickness of the skirt is less than a thickness of the wall.

11. The protective cover according to claim 10, wherein the aperture is surrounded by a counterbore which defines a bore surface in the wall, and the skirt extends inwardly from the bore surface.

12. The protective cover according to claim 9, wherein the skirt is integrally molded with the wall.

13. The protective cover according to claim 9, wherein the shell includes a receptacle portion which is dimensioned to receive the connector therein, and the wall is hingedly connected to the receptacle portion.

14. The protective cover according to claim 13, wherein the shell includes a latch mechanism for securing the wall in a closed position on the receptacle portion.

15. The protective cover according to claim 9, wherein the shell includes a plurality of said apertures arrayed linearly along the wall.

16. The protective cover according to claim 9, wherein the aperture is circular.

* * * * *